US005611507A

United States Patent [19]

Smith

[11] Patent Number: 5,611,507

[45] Date of Patent: Mar. 18, 1997

[54] SECURE BAG HOLDING DEVICE

[76] Inventor: Jimmy R. Smith, 4439 Trout Valley Dr., Memphis, Tenn. 38141

[21] Appl. No.: 441,364

[22] Filed: May 15, 1995

[51] Int. Cl.[6] ..... B65B 67/04

[52] U.S. Cl. ..... 248/99; 248/101; 248/316.7

[58] Field of Search ..... 248/97, 99, 101, 248/316.7, 74.2; 220/908

[56] References Cited

U.S. PATENT DOCUMENTS

| | | | |
|---|---|---|---|
| 2,025,932 | 12/1935 | Beldin . | |
| 3,128,904 | 4/1964 | Reilly . | |
| 3,443,745 | 5/1969 | Kleeberg | 248/101 X |
| 3,604,677 | 9/1971 | Gits | 248/97 |
| 3,667,381 | 6/1972 | Bottas et al. . | |
| 3,784,049 | 1/1974 | Hawk | 248/99 X |
| 4,027,774 | 6/1977 | Cote . | |
| 4,457,483 | 7/1984 | Gagne | 248/99 X |
| 4,589,570 | 5/1986 | Auten | 220/908 X |
| 4,609,171 | 9/1986 | Matsui | 248/74.2 X |
| 4,834,260 | 5/1989 | Auten | 220/908 X |
| 4,923,087 | 5/1990 | Burrows | 220/908 X |
| 5,090,585 | 2/1992 | Power | 248/99 X |
| 5,100,087 | 3/1992 | Ashby | 248/97 |
| 5,230,489 | 7/1993 | White et al. | 248/74.2 |
| 5,261,553 | 11/1993 | Mueller et al. | 248/101 X |
| 5,419,452 | 5/1995 | Mueller et al. | 220/908 X |

*Primary Examiner*—Ramon O. Ramirez
*Assistant Examiner*—Michael J. Turgeon
*Attorney, Agent, or Firm*—Michael I. Kroll

[57] ABSTRACT

A secure bag holding device comprising a container having an open top to receive a removable bag. A structure on an exterior surface of the container below the open top is for anchoring a free edge of the bag in a released manner thereto, so that a person doesn't have to search for the free edge of the bag after it is filled with articles.

1 Claim, 2 Drawing Sheets

SECURE BAG HOLDING DEVICE

BACKGROUND OF THE INVENTION

1. Field of the Invention

The instant invention relates generally to lined containers and more specifically it relates to a secure bag holding device.

2. Description of the Prior Art

Numerous lined containers have been provided in prior art. For example, U.S. Pat. Nos. 2,205,932 to Beldin; 3,128,904 to Reilly; 3,667,381 to Bottas et al. and 4,027,774 to Cote all are illustrative of such prior art. While these units may be suitable for the particular purpose to which they address, they would not be as suitable for the purposes of the present invention as heretofore described.

BELDIN, CLAUDE S.

RUBBER LINED METAL BARREL

U.S. Pat. No. 2,025,932

A full open head metal barrel having at its open end an out-turned roll integral with the wall of the barrel. An imperforate rolling loose rubber lining conforms to and is in contact with the exterior surface of the roll. The lining is disconnected from the roll and proves below the roll a skirt. The skirt is detached from, is in contact with and by its elasticity hugs the outside surface of the curved wall of the barrel, while extending towards the bilge.

REILLY, HUGH A.

CONTAINER AND READILY REMOVABLE LINERS THEREFOR

U.S. Pat. No. 3,128,904

A waste and trash collector comprising an open-top container having a bottom wall and upstanding side and end walls defining a receptacle portion having individual corners. A liner positioning and retaining means is mounted on the interior of the receptacle portion and is secured in the respective corners. Hold down hooks are mounted on exterior upper portions of the upstanding walls. The positioning and retaining means consists of inwardly and upwardly directed anchoring members for cooperating corner portions of inserted and removable liners.

BOTTAS, MICHAEL J.

DIFLEY, CHARLES R.

REFUSE COMPACTOR AND BAG THEREFOR

A refuse receiver in a refuse compactor comprising a receptacle having an open top bounded by peripheral edge portions. A refuse holding bag in the receptacle has a double cuff formed by a pair of successive outward folds of the edge of the bag. Opposite edge portions of the bag each have a single slit that facilitates folding of the bag sides in the pair of successive outward folds to form the double cuff. The single slits facilitates the folding without excessive danger of refuse spillage through the bag sides at the slits during removal of a filled bag from the compactor. A refuse holding disposable bag having this construction is for positioning in a refuse receptacle having an open top in which refuse is compacted.

COTE, LEOPOLD J.

RUBBISH CONTAINER

U.S. Pat. No. 4,027,774

A container, such as a rubbish container, is adapted to secure a flexible plastic liner in an open position conforming to the shape of the container's interior. The securing of the flexible plastic liner is accomplished by the cooperation of the rim of the container about the periphery of which the edge of the flexible plastic liner is tightened forming an ear in the holder's hand. A notched member, into which the ear is inserted, is to hold the flexible plastic liner securely in the proper position in the container.

SUMMARY OF THE INVENTION

A primary object of the present invention is to provide a secure bag holding device that will overcome the shortcomings of the prior art devices.

Another object is to provide a secure bag holding device in which a container is equipped with external clip modules, to retain a free edge of a flexible plastic bag extending over a rim thereto, so that a person doesn't have to search for the free edge of the bag after it is filled.

An additional object is to provide a secure bag holding device in which the external clip modules can be attachable to an existing container or be made integral with the container when manufactured, so as to accomplish the desired task as stated above.

A further object is to provide a secure bag holding device that is simple and easy to use.

A still further object is to provide a secure bag holding device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
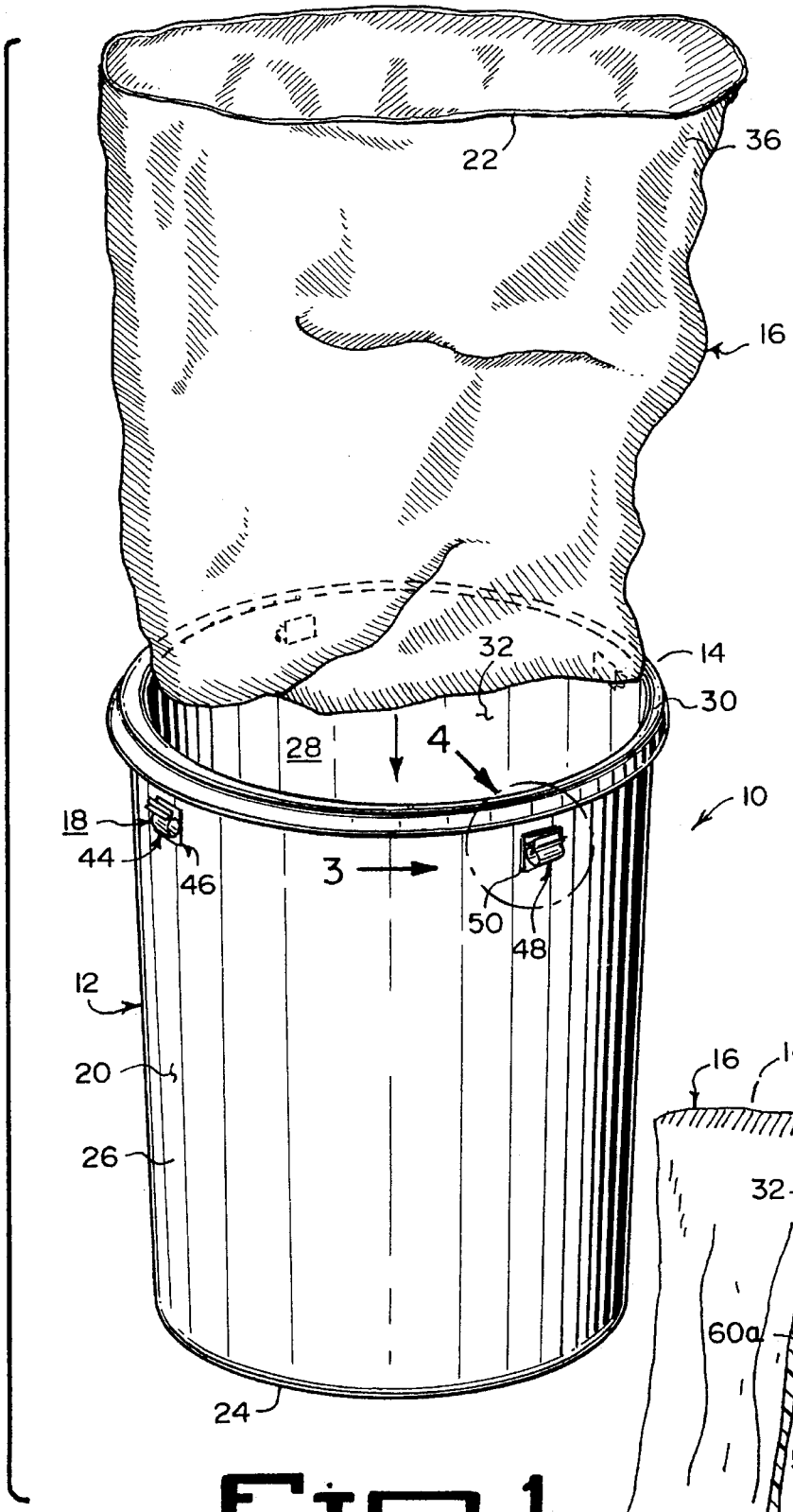
FIG. 1 is a perspective view of the instant invention, showing the flexible plastic bag ready to be inserted into the open top container.

Turning now descriptively to the drawings, in which similar reference characters denote similar elements throughout the several views, FIGS. 1 through 6 illustrate a secure bag holding device 10, comprising a container 12 having an open top 14 to receive an inserted and removable bag 16. A structure 18 on an exterior surface 20 of the container 12 below the open top 14 is for anchoring a free edge 22 of the bag 16 in a released manner thereto, so that a person doesn't have to search for the free edge 22 of the bag after it is filled with articles.

The container 12 includes a bottom wall 24. An upstanding wall 26 about the bottom wall defines a compartment 28 therein. A rim 30 is about the open top 14 of the upstanding wall 26.

The readily inserted and removable bag 16 is for protectively covering an interior surface 32 of the upstanding wall 26 of the container 12. The bag 16 has a compartment 34 therein, to receive the articles deposited. An upper portion 36 of the bag 16 can be folded over the upstanding wall 26 and hang down to form a skirt 38, allowing the anchoring structure 18 to release and engage with the free edge 22 on the skirt 38.

The upstanding wall 26 of the container 12 is substantially cylindrical shaped. The rim 30 is substantially ring shaped about the open top 14 of the upstanding wall. When the bag 16 is inserted within the container 12, it will be similarly cylindrical shaped. The container 12 is fabricated out of a strong durable plastic material. The bag 16 is fabricated out of a thin flexible plastic material.

The anchoring structure 18 consists of a plurality of clamp members 44 disposed on the container 12 about and below the open top 14. Each clamp member 44 will release and engage with one portion of the free edge 22 of the bag 16.

Each clamp member 44, as shown in FIGS. 1 through 5, includes a base plate 46. A clip 48 on an outer surface 50 of the base plate 46 is to retain in a released manner the one portion of the free edge 22 of the bag 16. An adhesive layer 52 on an inner surface 54 of the base plate 46, is to secure the base plate 46 to the exterior surface 20 of the container 12 below the open top 14.

The clip 48 consists of an L-shaped stationary arm 56 extending from the outer surface 50 of the base plate 46. A curved movable arm 58 extends from the outer surface 50 of the base plate 46. The movable arm 58 will engage with the stationary arm 56 to trap the free edge 22 of the bag 16 therebetween. A release tab 60 on the movable arm 58, can be manually manipulated to disengage the movable arm 58 from the stationary arm 56.

Figure 6:
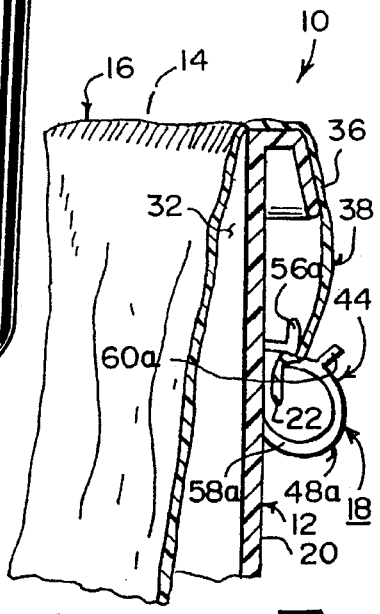
FIG. 6 is an enlarged cross sectional view similar to FIG. 5, showing an integral formed clip module in place of the attachable clip module.
Figure 2:
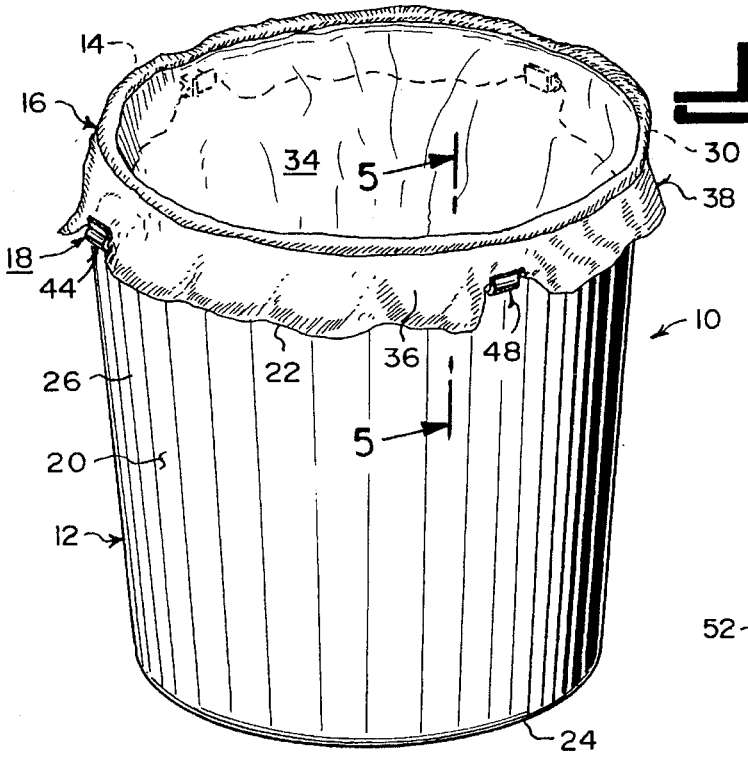
FIG. 2 is a perspective view similar to FIG. 1, showing the flexible plastic bag inserted therein and retained thereto.
Figure 3:
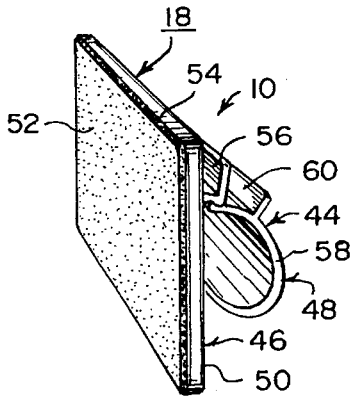
FIG. 3 is an enlarged perspective view of one of the attachable clip modules taken in the direction of arrow 3 in FIG. 1.
Figure 4:
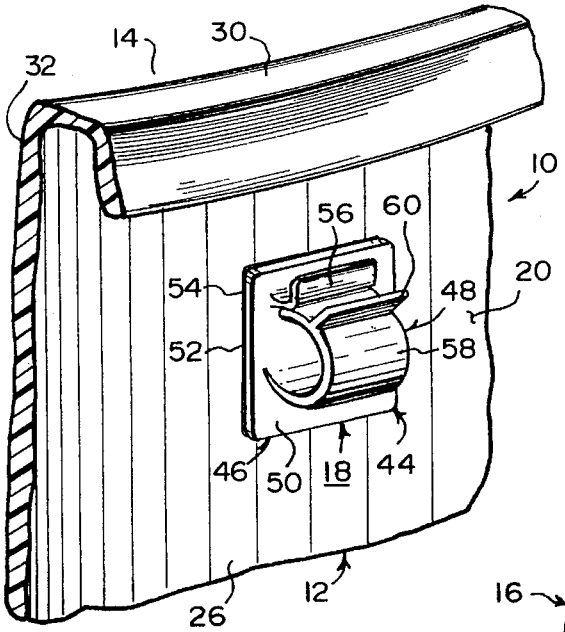
FIG. 4 is an enlarged perspective view of a portion thereof, as indicated by arrow 4 in FIG. 1.
Figure 5:
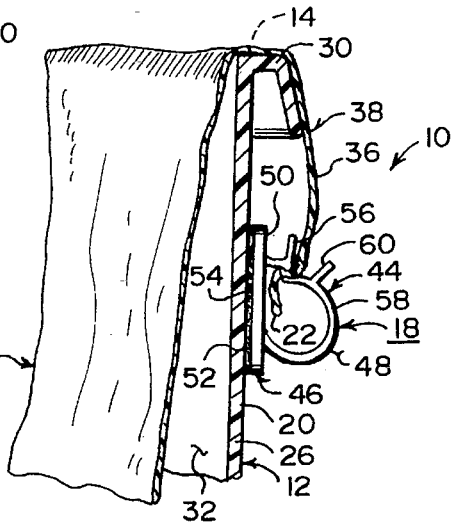
FIG. 5 is an enlarged cross sectional view taken along line 5—5 in FIG. 2.

Each clamp member 44 can also include a clip **48*a* integrally formed to the exterior surface 20 of the container 12 below the open top 14, to retain in a released manner the one portion of the free edge 22 of the bag 16, as shown in FIG. 6. The clip 48*a* includes an L-shaped stationary arm 56*a* extending from the exterior surface 20 of the container 12**.

A curved movable arm **58*a* extends from the exterior surface 20 of the container 12. The movable arm 58*a* will engage with the stationary arm 56*a* to trap the free edge 22 of the bag 16 therebetween. A release tab 60*a* on the movable arm 58*a* can be manually manipulated, to disengage the movable arm 58*a* from the stationary arm 56*a***.

OPERATION OF THE INVENTION

To use the secure bag holding device 10, the following steps should be taken:

1. Place the bag 16 into the compartment 28 of the container 12.
2. Fold over the upper portion 36 of the bag 16, so that it hangs down over the upstanding wall 26 to form the skirt 38.
3. Press back each release tab 60 or **60*a* on each movable arm 58 or 58*a***.
4. Insert the free edge 22 on the skirt 38 between each stationary arm 56 or **56*a***.
5. Release the release tab 60 or **60*a*, so that the free edge 22** will be trapped.
6. Fill up the compartment 34 in the bag 16 with articles.
7. Press back each release tab 60 or **60*a* again on each movable arm 58 or 58*a***.
8. Pull out the free edge 22 of the bag 16.
9. Remove the full bag 16 from the compartment 28 of the container 12 for proper disposal.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A secure bag holding device comprising:

a) a container of strong durable plastic material having an open top to receive an inserted and removable bag and an upstanding outer wall; and b) means on an exterior surface of said outer wall below the open top for anchoring a free edge of a bag of thin flexible plastic material in a releasable manner permitting a person to readily locate and release the free edge of the bag after it is filled with articles, said anchoring means comprising a plurality of clamp members disposed on the outer surface of said upstanding wall about and below the open top, each clamp member comprising a base plate, an adhesive layer on an inner surface of said base plate to secure said base plate to said outer surface, and clip means on the outer surface of said base plate to retain a portion of the free edge of said bag, said clip means including an L-shaped stationary arm extending from the outer surface of said base plate and having a free end, a curved movable arm extending from the outer surface of said base plate and having a release tab on said arm, said stationary arm overlapping and contacting the free end of said movable arm, said movable arm being biased to maintain said contact, said release tab being manually manipulated to separate the two arms by pushing said free end toward said base plate to permit said portion of the free edge of said bag to be inserted to be retained by said clip means or separate the two arms to release portion of the free edge of said bag when being trapped by said clip means.

* * * * *